US007421893B1

(12) United States Patent
Mann, II et al.

(10) Patent No.: US 7,421,893 B1
(45) Date of Patent: Sep. 9, 2008

(54) BULLET TEST TUBE AND METHOD

(76) Inventors: Richard A. Mann, II, Route 2 Box 92 Rocky Branch Rd., Princeton, WV (US) 24740; Charles H. Slsk, 400 County Road 2340, Dayton, TX (US) 77535; Joseph M. Natoli, 7711 Hertfordshire Dr., Spring, TX (US) 77379

( * ) Notice: Subject to any disclaimer, the term of this patent is extended or adjusted under 35 U.S.C. 154(b) by 168 days.

(21) Appl. No.: 11/442,540

(22) Filed: May 30, 2006

Related U.S. Application Data

(60) Provisional application No. 60/737,170, filed on Nov. 15, 2005.

(51) Int. Cl.
*G01L 5/14* (2006.01)

(52) U.S. Cl. ..... 73/167

(58) Field of Classification Search ..... 73/167; 273/410; 89/36.02
See application file for complete search history.

(56) References Cited

U.S. PATENT DOCUMENTS

| | | | | | |
|---|---|---|---|---|---|
| 523,510 | A * | 7/1894 | Brunswig | 73/167 |
| 941,642 | A * | 11/1909 | Maxim | 273/410 |
| 2,356,992 | A * | 8/1944 | Gilson | 73/167 |
| 2,998,719 | A | 9/1961 | Rubin | |
| 3,130,575 | A | 4/1964 | Rogers | |
| 3,217,534 | A * | 11/1965 | Bingham et al. | 73/167 |
| 4,235,444 | A * | 11/1980 | Meyer | 273/403 |
| 4,300,389 | A * | 11/1981 | Tevelow | 73/167 |
| 4,345,460 | A * | 8/1982 | Curchack et al. | 73/167 |
| 4,921,256 | A * | 5/1990 | Gearhart | 273/378 |
| 5,029,874 | A * | 7/1991 | Lamboy | 273/408 |
| 5,531,113 | A | 7/1996 | Jamison | |
| 5,778,725 | A * | 7/1998 | Kirschner et al. | 73/167 |
| 5,850,033 | A * | 12/1998 | Mirzeabasov et al. | 73/12.01 |
| 6,475,800 | B1 * | 11/2002 | Hazen et al. | 436/8 |
| 6,722,195 | B2 * | 4/2004 | Duke | 73/167 |
| 6,732,628 | B1 * | 5/2004 | Coburn et al. | 89/36.02 |
| 6,769,286 | B2 * | 8/2004 | Biermann et al. | 73/12.01 |
| 6,808,178 | B1 * | 10/2004 | Sovine | 273/410 |
| 6,837,496 | B2 * | 1/2005 | Larson et al. | 273/410 |
| 7,111,847 | B2 * | 9/2006 | Larson et al. | 273/410 |
| 7,134,664 | B2 * | 11/2006 | Tom et al. | 273/410 |
| 7,182,015 | B2 * | 2/2007 | Young | 89/160 |
| 7,222,525 | B1 * | 5/2007 | Jones | 73/167 |
| 2004/0067591 | A1 * | 4/2004 | Madsen et al. | 436/8 |
| 2005/0026125 | A1 * | 2/2005 | Toly | 434/262 |

* cited by examiner

*Primary Examiner*—Hezron E. Williams
*Assistant Examiner*—John Fitzgerald
(74) *Attorney, Agent, or Firm*—Gordon K. Anderson

(57) ABSTRACT

A bullet test tube (10) is taught having a media (22) for measuring a wound cavity (20), bullet penetration (52) and recovering a bullet (30) from a discharged firearm. The bullet test tube is made with an integral cylindrical tube (24) with both ends (26) open, cut to length from a cardboard tubular shipping container having a foil liner (28). The tube is filled with the media by casting at an elevated temperature preventing adherence to the sides of the tube and allowing the media to solidify internally without cracks or other deformities. A basic test tube (32) is utilized and a varied number of extenders (34) may be added according to the energy influence of bullet (30) under test. Covers (48) and (50) are provided to enclose the open ends of the various cylindrical tubes preventing contamination from debris during handling and shipping.

17 Claims, 3 Drawing Sheets

BULLET TEST TUBE AND METHOD

CROSS REFERENCE TO RELATED APPLICATION

This application claims priority of Provisional Patent Application Ser. No. 60/737,170 filed Nov. 15, 2005.

TECHNICAL FIELD

The present invention relates to apparatus and methods of measuring the terminal ballistics for projectiles in general. More specifically to a reusable recovery medium and packaging for capturing and testing terminal bullet performance.

BACKGROUND ART

Previously, many types of devices and systems have been used in endeavoring to provide an effective means to measure the ballistic effect of a given bullet relative to a media that claims replication of animal tissue.

The use of compliant or recovering mediums to capture and test bullet performance has been known for many decades. Various materials along these lines have been used by shooters and are presently offered commercially. However, what is particularly different and unique about the invention is the manner in which it is prepared, packaged, offered to users and the adaptability of these testing procedures to suit the needs of individual tests based on the bullet and cartridge combination to be tested. Additionally, the components and methods developed for re-use and re-molding of these materials are new, unique and dynamically different than other products having the same utility.

Some of the materials available and in present use for established and experimental bullet and ballistic testing are described individually with their limitations and restrictions relative to the instant invention as follows:

Ordinance gelatin is based on organic vegetable substances that are mixed by the end user following complex and rigid instructions under controlled temperatures. The gelatin must be maintained at a cool temperature prior to and up to the point of shooting with the shelf life limited to above 40 degrees F. (4.44 degrees C.). No volume measurement of the wound cavity is allowed therefore it must be examined quickly before deterioration consequently not maintaining nor preserving the bullet affects indefinitely. The base material is water soluble and will not maintain consistency if remade due to loss of water content. Since the gelatin is mixed with water originally it requires extensive preparation before shooting and is difficult for transportation to the shooting facility. No data is available to ascertain the appropriate lengths for given cartridges to be tested particularly powerful cartridges that have deep penetration. The gelatin requires excessive lengths for stopping. No protection is provided for handling as the exposed media or surface allows the attraction of contaminates such as dirt and dust.

CORBIN SLIM TES™ ballistic testing medium is organic in makeup which will deteriorate if not stored in a cool dry atmosphere. The material will not capture or allow volumetric or any other measurement of the wound cavity. This product does not provide any expandability features thru packaging. As with the above Ordinance gelatin no data is available on appropriate lengths for particular cartridges to be tested. Since the material is organic it is not easily reused and its exposed surface allows the attraction of contaminates.

PERMA-GEL® ballistic testing medium is a plastic rubber like resilient non-organic material which is unstable when impacted by bullet. The material is difficult to filter for re-use and requires a high melting temperature using a specialty re-melting unit. The wound cavity measurement is not available using a volume by weight of water and the resiliency of the material permits the potential for reverse launching of the bullet.

ROOSTER™ ballistic testing medium and the material known as MAKI™ testing media provides no integrated extension or expandability features thru packaging and is not recommended for end user re-casting or re-melt. The material is not easy to handle in as-shipped form and is difficult to measure the wound cavity by volume on a consistent basis without sectioning the material after shooting.

The patented prior art listed below did not disclose patents that possess any of the novelty of the instant invention; however the following U.S. patents are considered somewhat related:

| U.S. Pat. No. | Inventor | Issue Date |
|---|---|---|
| 2,998,719 | Rubin | Sep. 5, 1961 |
| 3,130,575 | Rogers | Apr. 28, 1964 |
| 5,531,113 | Jamison | Jul. 2, 1996 |

Rubin in U.S. Pat. No. 2,998,719 teaches a shock tube for studying warhead combination damage to a target caused by the blast effect as well as by fragments from a warhead. The shock tube has a uniform cross section closed on one end and open on the other with a thin diaphragm dividing the tube into a compression chamber and an expansion chamber. The projectile punctures the diaphragm which disintegrates and the shock wave and fragment damage is measured and studied.

U.S. Pat. No. 3,130,575 issued to Rogers is for an impact test apparatus for staging high velocity impact experiments under accurately controlled conditions. A barrel is provided with an extension having slots and a series of gas expansion chambers surround the barrel. When a jet of metal strikes the model it forms a luminous shock wave which is recorded by a camera.

Jamison in U.S. Pat. No. 5,531,113 discloses a ballistic measuring system having a plurality of pressure transducers spaced apart longitudinally along a mass of fluid sensing disturbances in the fluid. A gun is discharged into the fluid and a computer is connected to the transducers which process the output creating a response curve related to the energy dissipation of the projectile.

DISCLOSURE OF THE INVENTION

The primary object of the invention is to create an easy to use bullet testing media that is affordable, portable, versatile, user friendly in application and having the capability of being re-used. The invention also allows the recovery of a bullet to measure its retained weight, expanded diameter, determine penetration along with determining the size, shape and volume of the wound cavity. Additionally, the invention utilizes a bullet testing material that does not react violently to the bullet impact possibly damaging the supporting surface and does not have the potential to launch the media from its resting point at the time of bullet impact and piercing. The inventive concept was based on the realization that a soft wax media formed into a tubular or cylindrical shape would allow all of the above features to be accomplished in a compact easy to use and re-useable format. The parameters of the invention therefore included the following goals:

Must be affordable.

Must be non-toxic.

Must have an indefinite shelf life.

Must be able to be stored at room temperature without breakdown.

Best results must be obtainable at room temperature.

Must not be water soluble.

Must offer an expandable, adjustable user friendly packaging system.

Must be available in a format that requires no preparation prior to use.

Must be provided and available to the user in a format ready to shoot.

Must capture most common rifle bullets within 24 inches (61 cm).

Must provide consistent results.

Must capture or retain the "wound" cavity formed by the bullet during penetration and expansion.

Must be able to capture the wound cavity in a separate unit.

Must be portable/transportable from home/lab to and from shooting range.

The wound cavity capture block must be of a consistent size to allow accurate comparison of various bullets.

An important object of the invention is the simplicity of design and function with the prime element being the test tube itself which consists of media melted into a foil lined shipping tube preferably measuring 11 inches (27.94 cm) in length. This unit is specifically designed to capture the wound cavity or stretch cavity of the bullet that is fired into it. Additional components designated as extenders, or as known by there trade name Xtenders, utilize the same media and tube but have varying depths of media according to their utility.

Another object of the invention is its adaptability as the extenders optionally slip onto the original test tube with a tight fit allowing them to be shipped as one unit or the extenders may be purchased separately and connected to the test tube as desired by the wholesaler or end user. Both the test tube and extenders may be sold separately however both of these items come complete with their own end caps for secure shipping. This uniquely fitted; adjustable, portable, expandable, molding, shipping configuration is the core of the design of this bullet testing device. The tubular elements of the invention permits the media to be prepared in a structurally sound manner that will protect, preserve and exhibit the affects of the bullet with regularity and without disruption and further allows convenient shipment and extreme ease of handling.

Still another object of the invention is its consistency as it has been found that the media provides consistent bullet capturing features such that bullet penetration may be predicted to a depth of within +/−10% based on retained weight, expanded diameter and impact velocity. This prediction was arrived at after the extensive testing of multiple bullets over a wide range of impact velocities and its accuracy verifies the consistency of the media for the intended purpose. Furthermore, bullets that show penetration near the outside of this margin of error show extremely early initial expansion or delayed or unusually deep depths of expansion termination.

Yet another object of the invention is that casting the media into the foil lined tubes allows consistent measurement and comparison of wound cavities which has been previously unattainable thru the use of other casting or molding techniques without excessive additional labor on the part of the end user. Additionally the media inside the bullet test tube has been configured to induce, and found to effectively and repeatedly simulate, the stresses on bullets similar to those experienced during the time that bullets are passing thru animal tissues. Other preparations of this type of similar material have required handling in its bare form, molded in small pieces or contained within thin plastic bags. These prior methods of preparation and use have no provision for the end user to assemble appropriate lengths of this material in a sturdy platform that was adaptable for the specific test subject and that permitted handling without direct contact.

A further object of the invention is directed to the fact that current non-wax like media allow the wound cavity of the bullet to expand outside the confines of the material. This type of media grows or expands violently as the bullet passes thru. This expansion of the material in affect launches the media off of and away from its resting place at the time of bullet impact. Other wax-like materials that are cast inside plastic bag type liners sometimes form the media into imperfect cylinders that often exhibit excessive cracking when impacted by the bullet.

A final object of the invention is that the expandable, portable, interlocking, user adjustable packaging system eliminates the need for the waxy substance of the test tube or any other bullet testing material of a wax like or any similar or exclusively different material to be handled by the tester by hand prior use. The packaging system also prevents the loss of material due to over expansion and or dissection by the bullet or user respectively. Finally, the invention allows for the complete and detailed measurement of the wound cavity created by the bullet in a container specifically designed for that purpose.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
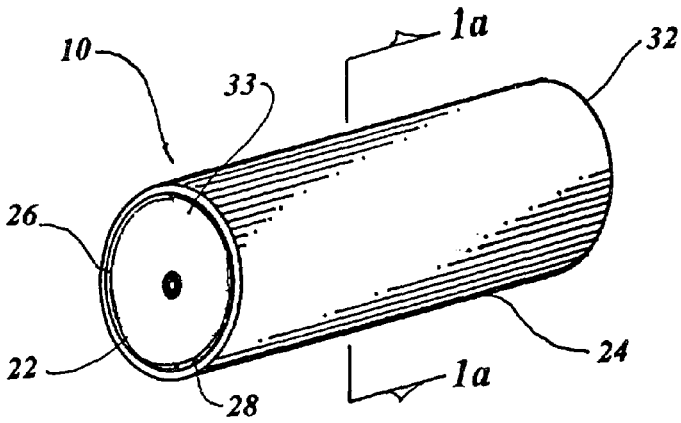
FIG. 1 is a partial isometric view of the test tube in the preferred embodiment.
Figure 1A:
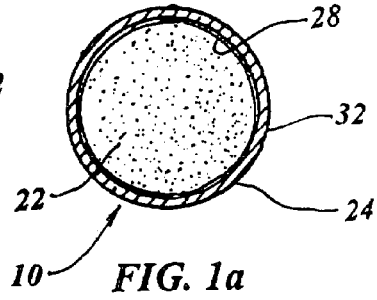
FIG. 1*a* is a cross sectional view taken along lines 1*a*-1*a* of FIG. 1.

The best mode for carrying out the invention is presented in terms of a preferred embodiment. This preferred embodiment is shown in FIGS. 1 thorough 19 and is comprised of a ballistic test tube 10 for measuring a wound cavity 20, bullet penetration and bullet recovery in a media 22 which has been configured to induce, and found to effectively and repeatedly simulate, the stresses on bullets similar to those experienced during the time that bullets are passing thru animal tissues. The bullet test tubes 10, in all of its forms, are essentially made of an integral cylindrical tube 24 that has both ends 26 open, preferably using a cardboard tubular shipping container having a foil liner 28.

The cylindrical tube 24 is filled with the media 22 by casting at an elevated temperature. This method of casting directly into the cylindrical tube 24 prevents the wax-like media 22 from adhering to the sides of the cylindrical tube 24 allowing the media 22 to solidify internally without cracks or other deformities. This perfectly uniform solidification of media 22 without air bubbles is imperative to the preservation of the bullet's true affects and for the bullet test tube 10 to maintain its structural integrity, outward appearance and original size during bullet impact and piercing.

The invention utilizes a number of length combinations and configurations of bullet test tubes 10 to accommodate the entire range of bullets 30 fired from small handguns to the largest African game rifles. This varied length requirement necessitates a basic test tube 32 having a specific outside diameter and a series of extenders 34 that are sized to tightly fit over the end of the basic test tube 32 extending the overall length to achieve the appropriate amplitude.

The basic test tube 32, as illustrated in FIGS. 1, 2, 10-16 and 18, consists of a cylindrical tube 24 preferably having an inside diameter of essentially 5.75 inches (14.60 cm) with a 0.0625 inch (0.16 cm) thick wall and a length of approximately 11.00 inches (27.94 cm). The basic test tube 32 has the media 22 contained within its entire length.

Figure 1B:
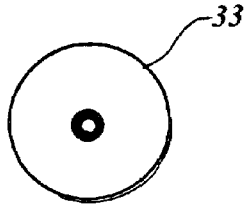
FIG. 1*b* is a front elevation view of the target disk shown separately for clarity.
Figure 2:
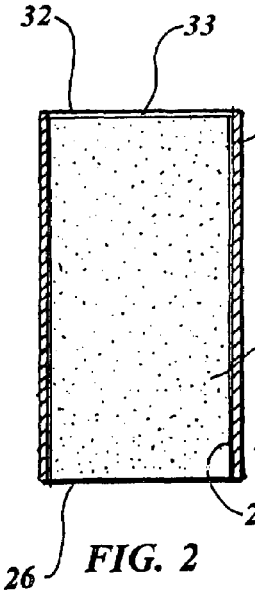
FIG. 2 is a cross sectional view taken along an imaginary center line of the test tube in its preferred embodiment.

A target disk 33 is disposed within an open end of the basic test tube 32 for an aiming point to direct a bullet to enter into the center of the test tube 32 for providing an optimum evaluation. The target disc 33 is formed of cardboard preferably having a thickness of essentially 0.0625 inch (0.16 cm) with a diameter to fit inside one open end of the test tube 32, as illustrated in FIG. 1 and shown separately in FIG. 1*b*.

The extenders 34, as shown pictorially in FIGS. 3-5, 14-16 and 19, consist of a cylindrical tube 24 preferably having an inside diameter of essentially 5.875 inches (14.60 cm) with a 0.0625 inch (0.16 cm) thick wall and in three lengths of 5.5 inches (13.97 cm), 8.5 inches (21.59 cm) and 11 inches (27.94 cm). The media contained within is from 4.00 to 10.00 inches (10.16 to 25.4 cm) from one of the open ends.

The following designations apply to the extenders 34:

- A short magnum extender 36 having a 4 inch (10.2 cm) depth of media 22;
- A magnum extender 38 having a 7 inch (17.8 cm) depth of media 22;
- An ultra magnum extender 40 having a 10 inch (25.4 cm) depth of media 22.

Figure 3:
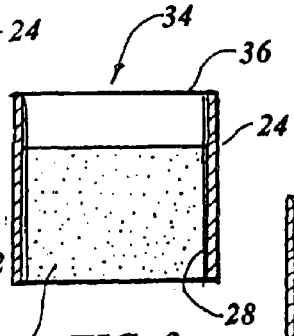
FIG. 3 is a cross sectional view taken along an imaginary center line of the short magnum extender in its preferred embodiment.
Figure 4:
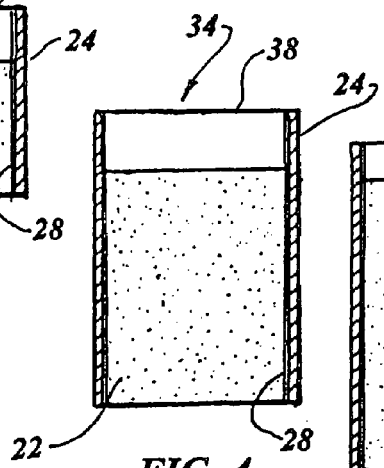
FIG. 4 is a cross sectional view taken along an imaginary center line of the magnum extender in its preferred embodiment.
Figure 5:
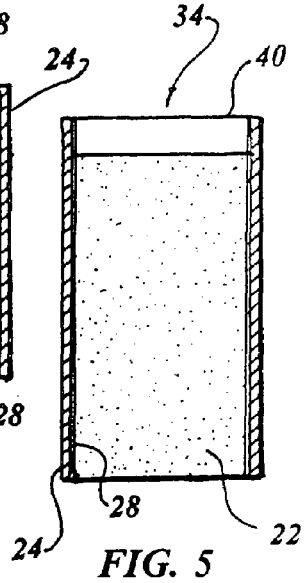
FIG. 5 is a cross sectional view taken along an imaginary center line of the ultra magnum extender in its preferred embodiment.
Figure 11:
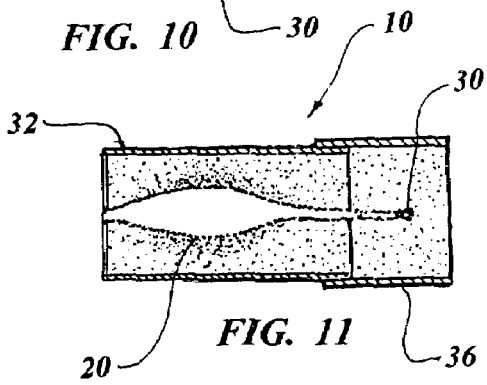
FIG. 11 is a cross sectional view taken along an imaginary center line of the test tube with a short magnum extender attached over the test tube after a bullet has penetrated the media leaving a wound cavity and the expanded bullet still in place.
Figure 12:
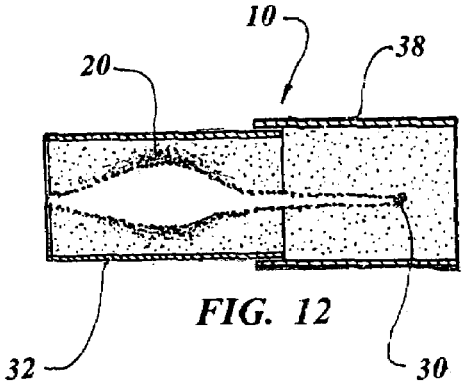
FIG. 12 is a cross sectional view taken along an imaginary center line of the test tube with a magnum extender attached over the test tube after a bullet has penetrated the media leaving a wound cavity and the expanded bullet still in place.
Figure 15:
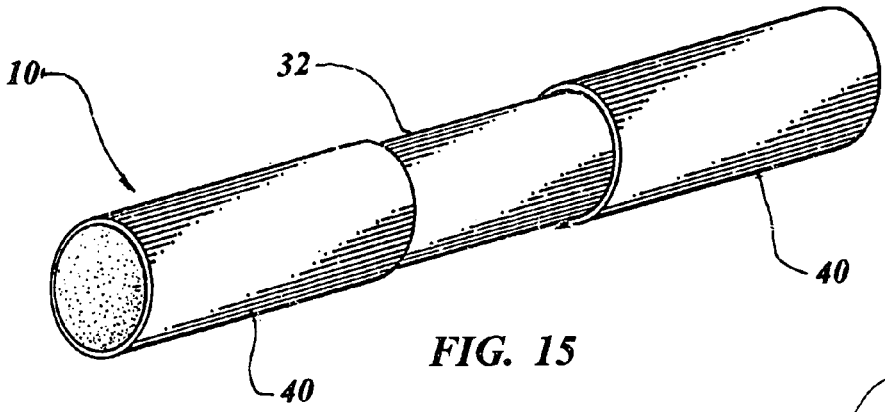
FIG. 15 is a partial isometric view of a test tube with an ultra magnum extender attached over each end.
Figure 16:
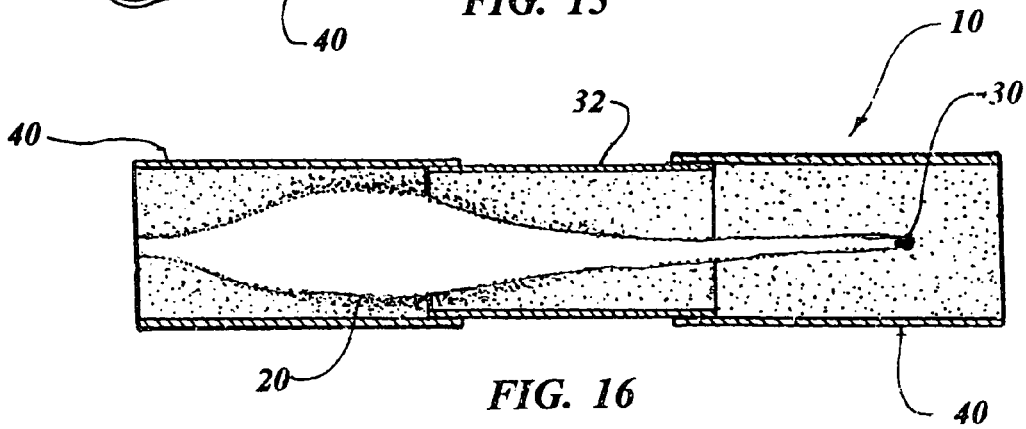
FIG. 16 is a cross sectional view taken along an imaginary center line of the test tube with an ultra magnum extender attached over the basic test tube on each end after a bullet has penetrated the media leaving a wound cavity and the expanded bullet still in place.

FIG. 3 illustrates the short magnum extender 36 alone and in FIG. 11 connected directly over a basic test tube 32. FIG. 4 depicts the magnum extender 38 alone and connected onto the basic test tube 32 in FIG. 12. The ultra magnum extender 40 and the basic test tube 32 are assembled together in FIG. 14 and the ultra magnum extender 40 is shown separately in FIG. 5. It is also possible to attach a magnum extender 38 on both ends of the basic test tube 32 for the most powerful rifle calibers, as depicted in FIGS. 15 and 16.

Figure 8:
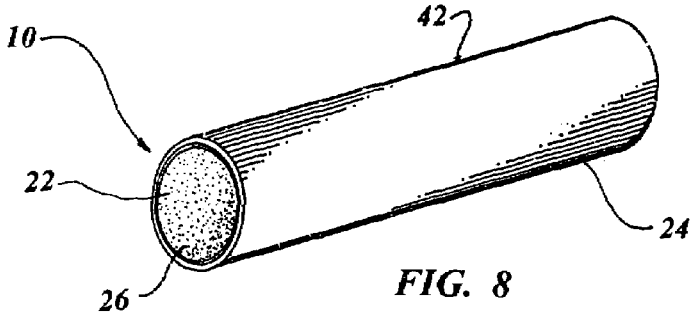
FIG. 8 is a partial isometric view of the super tube in the preferred embodiment.
Figure 9:
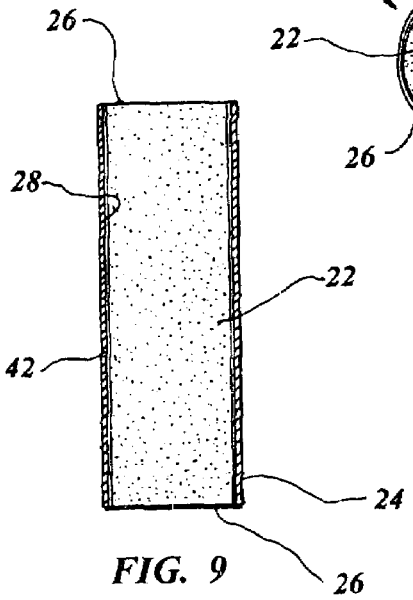
FIG. 9 is a cross sectional view taken along an imaginary center line of the super tube in its preferred embodiment.
Figure 10:
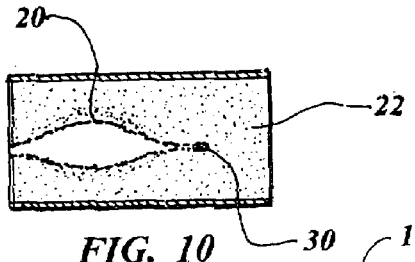
FIG. 10 is a cross sectional view taken along an imaginary center line of the test tube after a bullet has penetrated the media leaving a wound cavity and the expanded bullet still in place.
Figure 13:
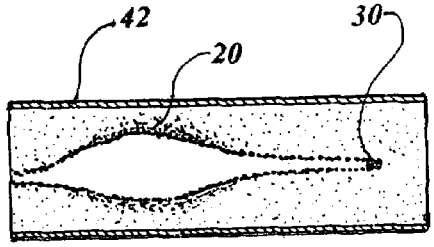
FIG. 13 is a cross sectional view taken along an imaginary center line of the super tube after a bullet has penetrated the media leaving a wound cavity and the expanded bullet still in place.
Figure 14:
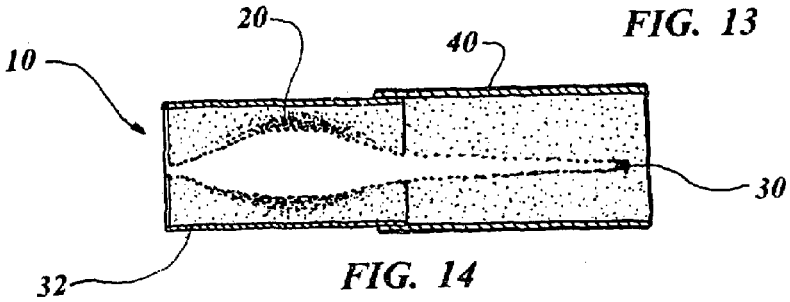
FIG. 14 is a cross sectional view taken along an imaginary center line of the test tube with an ultra magnum extender attached over the test tube after a bullet has penetrated the media leaving a wound cavity and the expanded bullet still in place.

Another version of the bullet test tube 10 consists of the same cardboard cylindrical tube 24 that has the identical nominal diameter as the basic test tube 32 except a length of 24 inches (60.96 cm) which is designated as a super tube 42 incorporating the media 22 its entire length, as shown in FIGS. 8, 9 and 13. The super tube 42 may optionally include the target disk 33 disposed within an open end the same as used in the basic test tube 32. The extra length of the super tube 42 provides a solid unit which is capable of capturing the complete penetration of the bullet 30 without the use of an extender 34. This special type of tube allows the media 22 to drop free of the super tube 42 which may be used for recasting providing a container and contents that are both re-useable. Like all of the cylindrical tubes 24 the foil liner 28 allows the media 22 to form into a consistent, solid mass when cooled with no imperfections or voids.

The media 22, disposed within the bullet test tube 10 is cast in a heated liquefied state and solidified at normal prevailing ambient temperatures. This media 22 has been configured to induce, simulate and effectively and repeatedly the stresses on bullets similar to those experienced during the time that bullets are passing thru animal tissues. The media 22 preferably consists of a mixture of microcrystalline and paraffin wax having a melt point of 165 to 175 degrees F. (73.89 to 79.44 degrees C.) and a viscosity of 14.3 to 18.0 at 210 degrees F. (98.89 degrees C.). This mixture of microcrystalline and paraffin wax preferably is made up of from 90 to 95 percent microcrystalline wax.

The composition of the preferred media 22 is described in specific detail below; however other similar wax containing materials having like characteristics are fully anticipated and fall within the scope of this invention.

Calwax, Multiwax W-835 or a similar proprietary mixture of microcrystalline and paraffin wax scented and colored having the following particular properties:

| MELT POINT ASTM D127 Min/Max | NEEDLE ASTM D1321 Min/Max @ 110 F. | VISCOSITY ASTM D3236 Min/Max @ 210 F. | FLASH POINT ASTM D92 |
|---|---|---|---|
| 165/175 F. | 60/80 | 14.3/18.0 | 475 F. |

Figure 6:
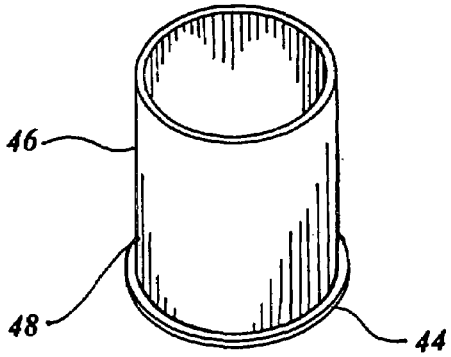
FIG. 6 is a partial isometric view of the test tube cap in the preferred embodiment.
Figure 7:
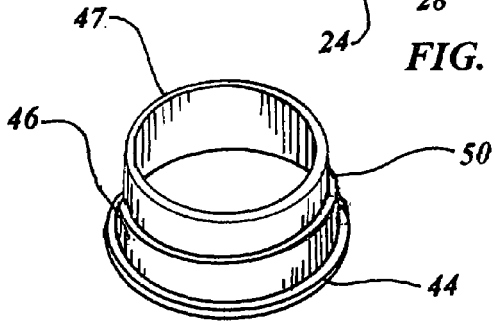
FIG. 7 is a partial isometric view of the extender cap in the preferred embodiment.

The bullet test tube 10 includes means for covering each open end of the cylindrical tube 24 which consists of an essentially flat base 44 attached to a circular side wall 46, as illustrated in FIGS. 6. A basic cover 48 incorporates a side wall 46 that has an inside diameter sufficiently large to slip over the outside diameter of the basic test tube 32 sealing the media 22 from the surrounding environment for shipment and storage. This basic cover 48 also interfaces with the super tube 42 as it has the same outside diameter as the basic test tube 32. An extender cover 50, depicted pictorially in FIG. 7, is formed with an essentially flat base 44 with the circular side wall 46 the same diameter as the extender 34. A secondary inner liner 47 is positioned inside the circular side wall 46 that has an outside diameter that is sized to slip into the extender 34 also sealing the media 22 from the surrounding environment. It will be noted that the short magnum extender 36 and magnum extender 38 may be used as covers for the basic test tube 32.

Figure 19:
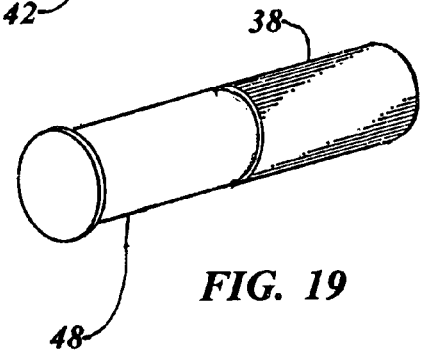
FIG. 19 is a partial isometric view of a combination of the basic test tube with cap attached with a short magnum extender with a basic cover on one end as arranged for storage or shipment.

The short magnum extender 36 and magnum extender 38 may be used as covers for the basic test tube 32. FIG. 19 depicts a typical combination of a basic test tube 32 with a magnum extender 38 and a basic cover 48. With the cover 48 and extender 38 in place, the bullet test tubes 10 may be sealed with shipping tape for storage and shipment.

For the actual testing of bullets, the user must select the tube configuration most appropriate for the cartridge/bullet/velocity intended as noted on the following chart:

| CARTRIDGE | TEST TUBE 11 inch (32) | SHORT MAG. EXTENDER 4 inch (36) | MAGNUM EXTENDER 7 inch (38) | ULTRA MAG. EXTENDER 10 inch (40) |
|---|---|---|---|---|
| Defensive Handgun | 1 | | | |
| Varmint Cartridges | 1 | | | |
| Low Velocity Rifle | 1 | 1 | | |
| High Velocity Rifle | 1 | | 1 | |
| Big Bore Rifle | 1 | | | 1 |

Examples of the above listed cartridge classes are as follows:

Defensive Handgun: 0.38 Smith and Wesson Special., 9 mm Parabellum, 0.357 Smith and Wesson Magnum, 0.40 Smith and Wesson, 0.45 Colt Automatic Pistol.

Varmint Cartridges: 0.22 Hornet, 0.223 Remington, 0.22-250 Remington, 0.220 Swift.

Low Velocity Rifle: 7×30 Waters, 30-30 Winchester, 0.35 Remington, Muzzle loading rifles.

High Velocity Rifle: 0.243 Winchester, 7 mm-08, 0.30-06 Springfield, 0.300 Winchester Magnum.

Big Bore Rifle: 0.338 Winchester Magnum., 35 Whelen, 0.340 Weatherby, 0.375 Holland and Holland magnum.

The basic test tube 32 and extenders 34 are designed for use with expanding bullets 30. The testing of solid or expanding bullets 30 that develop small frontal diameters during expansion will require additional extenders 34 such as illustrated in FIGS. 15 and 16.

The method for measuring a wound cavity 20, bullet penetration 52 and recovering and analyzing a expanded bullet 30 in a media 22 consists of the following steps:

a) heating the media 22 to a temperature of from 165 degrees F. to 175 degrees F. (73.89 to 79.44 degrees C.) until melted.

b) pouring the melted media slowly into a cylindrical tube to prevent air pockets and bubbles.

c) cooling the media within the cylindrical tube at a temperature of from 65 to 75 degrees F. (18.33 to 23.89 degrees C.) for a period of no less than 48 hours allowing the media to stabilize at the prevailing ambient room temperature.

d) firing a bullet 30 from a firearm from a distance of at least 20 yards (18.29 meters) into the center of one end of the media 22 inside the cylindrical tube 24.

Figure 17:
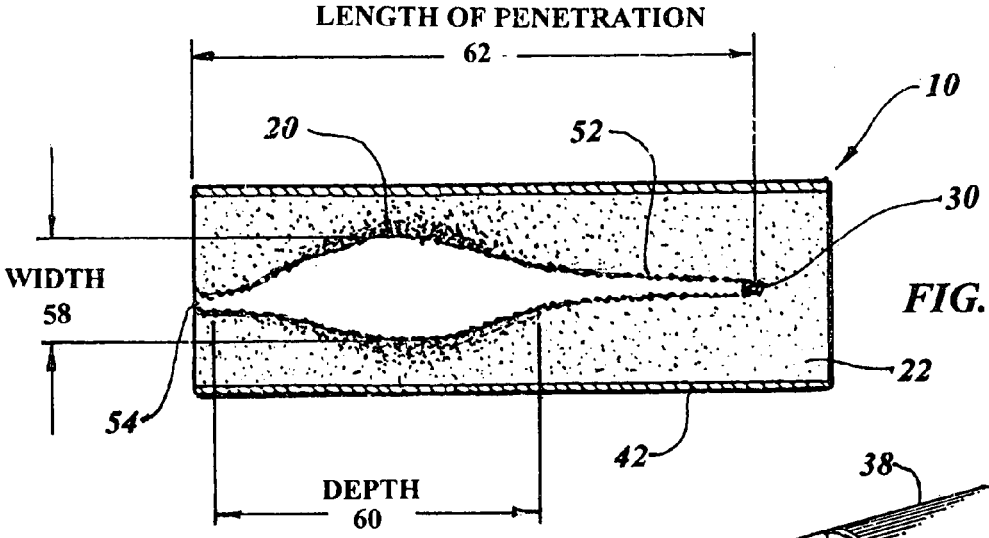
FIG. 17 is a cross sectional view taken along an imaginary center line of the super tube after a bullet has penetrated the media leaving a wound cavity and the expanded bullet still in place with dimensional designations delineating the wound cavity width and depth along with the bullet penetration length.
Figure 18:
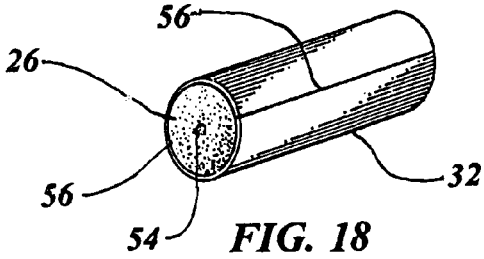
FIG. 18 is a partial isometric view of a basic test tube with marking guide lines across the longitudinal axis of the tube 180 degrees apart outlining the cutting location.

The distance between the bullet test tube 10 and the muzzle of the gun is important because some projectiles require a short distance after exiting the muzzle to stabilize. Un-stabilized projectiles may enter the bullet test tube 10 at an attitude of less or greater than 90 degrees. An entry of this nature may generate a wound cavity 20 unrepresentative of the bullets full potential in any media 22. The bullet test tube 10 must be positioned with its length perfectly aligned with the bore of the rifle such that when the bullet 30 is fired it passes thru the center (length wise) of the basic test tube 32 and any attached extender 34.

e) pouring water into an entrance hole in the media created by the fired bullet to determine the volume of the wound cavity 20.

f) measuring the water and recording the volume of the wound cavity created by the path of the fired bullet 30. The water is poured into the bullet test tube 10 thru the bullet entrance hole 54 from a measured container therefore accurately verifying the volume of the wound cavity 20. The bullet test tube 10 may then be turned upside down and the water poured out. In the event that any part of the bullet test tube 10 cracks during bullet 30 impact the wound cavity 20, these cracks may be sealed and measured in separate halves after the bullet test tube 10 has been split in two equal pieces. It may be noted that if the bullet 30 has exited the bullet test tube 10 the media 22 may be pinched over the exit hole allowing the bullet test tube 10 to retain the water inside for volumetric wound cavity 20 for measurement.

g) marking guide lines 56 across the longitudinal axis of the cylindrical tube 24 at 180 degrees apart and cutting the tube material along the lines 56 as shown in FIG. 18.

h) cutting the media 22 and cylindrical tube 24 in half using the guide lines 56 for assuring equal halves. A string or wire may be pulled thru the length of the bullet test tube 10 guided by a split along the guide lines 56 in the cardboard tube 24 exterior. This step effectively splits the wound cavity 20 in half allowing further measurements to be made which include width 58 of the wound cavity 20, depth 60 of the wound cavity 20 and length of penetration 62.

i) measuring the maximum expansion width, 58 and depth 60 of the wound cavity 20. The measurements of the cavity 20 are determined finding the first point after impact where the wound cavity 20 shows substantial increase over the initial bullet diameter and measuring to a point along the wound cavity 20 where it is the widest and the final point along the wound cavity where it reduces to the diameter of the recovered bullet 30. The width 58 of the wound cavity 20 is the widest point as illustrated in FIG. 17, the depth 64 is the dimension between the first and final point, is also shown in FIG. 17.

j) measuring the length of the bullet penetration 62 into the media 20. The length of penetration 62 is the measurement from the entrance hole 54 to the front of the expanded bullet 30. The ability to see and measure this cavity with a meaningful comparison at a controlled depth is unique to the invention and is in fact the purpose of the sectioned or compartmentalized and expandable bullet test tube 10 k) recovering the expanded bullet from the media 22. If the bullet 30 penetrated completely thru the basic test tube 32 it may be recovered from the extender 34. The extender 34 may be marked and cut in the same manner as the basic test tube 32 and then split with a string or wire. At this point the total length of penetration 62 may be determined by adding the 11 inch (27.94 cm) length of the basic test tube 32 and the depth the bullet 30 penetrated into the extender 34.

l) measuring the maximum diameter and the weight of the expanded bullet 30 also allowing the bullet 30 to be examined for integrity and expansion formation as well as measured for retained weight and expanded diameter.

m) comparing the weight of the expanded bullet 30 with an identical unfired bullet 30 and calculating the percentage of bullet 30 weight loss.

n) computing the terminal sectional density of the expanded bullet. This computation is similar to the determination of sectional density of the unfired bullet and is found by dividing the retained weight of the bullet 30 by its recovered diameter.

The method for measuring the wound cavity 20, bullet penetration 52 and recovering and analyzing a expanded bullet 30 in pre-used media 22 is basically the same steps as above described except starting with existing media 22, the steps therefore comprise:

a) collecting the pre-used media 22 from a previous test and discarding the cut cylindrical tube 24, b) cutting the media 22 into useable portions, c) melting the media 22 with indirect heat at a temperature above 175 degrees F. (79.44 degrees C.) until liquefied. This re-melt may be accomplished in several ways such as described below:

Since the melting point of the media 22 is well below the boiling point of water, a double boiler type unit may be used for melting. This is accomplished by placing a metal or glass container approved for such temperatures or usage above that of the boiling point of water inside another container that contains water which has been heated to a temperature of 165 to 175 degrees F. (73.9 to 79.4 degrees C.). This temperature will allow the media 22 to melt without being exposed to direct flame. When the media 22 liquefies at a temperature of about 165 to 170 degrees F. (73.9 to 76.7 degrees C.) it may be used. If more than one melting is required to reach the desired depth due to limitations in the melting container volume, second and subsequent uses may be accomplished to insure that the media 22 is mixed and combined in a liquid state.

A similar process could use a heat resistance plastic bag containing the media 22 which is placed inside a container with water at the described temperature. When the media 22 reaches a liquefied state the bag is held over the cylindrical tube 24 and the end of the plastic bag is clipped off and poured.

A third method is to melt the media 22 in an approved melting or heating pot where the media 22 is never directly exposed to the heating element or temperatures above 180 degrees F. (82.2 degrees C.). Some of these pots are commercially available with a spout that will allow the media 22 to be transferred easily. This is the preferred method because it insures even heating at the appropriate temperature throughout the media 22.

Another method for melting and re-casting involves a standard home crock-pot which is set on high or the setting with the temperature above but closest to the 165 degree F. (73.9 degrees C.) melting point. The crock-pot may be lined with a liner available in the foods section of most stores. The media 22 is placed in the liner and when it liquefies the bag is removed and used.

d) obtaining an uncut cylindrical tube 24 and pouring the melted media 22 slowly into the tube 24 precluding any air pockets and bubbles, e)) cooling the media 22 within the cylindrical tube at a temperature of from 65 to 75 degrees F. (18.33 to 23.89 degrees C.) for a period of no less than 48 hours allowing the media 22 to stabilize at the prevailing ambient room temperature, f) firing a bullet 30 from a firearm from a distance of at least 20 yards (18.29 meters) into the center of one end of the media 22 inside the cylindrical tube 24, g) pouring water into an entrance hole 54 in the media 22 created by the fired bullet 30, h) measuring the water and recording the volume of the wound cavity 20 created by the path of the fired bullet, i) marking guide lines 56 across the longitudinal axis of the cylindrical tube 24 at 180 degrees apart and cutting the tube material along the lines 56 as shown in FIG. 18, j) cutting the media 22 and cylindrical tube 24 in half through the guide lines 56 assuring equal halves, k) measuring the maximum expansion width 58, and depth 60 of the wound cavity 20, l) measuring the length of the bullet penetration 62 into the media 22, m) recovering the expanded bullet 30 from the media 22, n) measuring the maximum diameter and the weight of the expanded bullet 30, o) comparing the weight of the expanded bullet 30 with an identical unfired bullet 30 and calculating the percentage of bullet weight loss, and p) computing the terminal sectional density of the expanded bullet 30.

It will be noted that the bullet test tube 10, in either its original form or reused, should be shot when its core temperature is between 70 and 74 degrees F. (21.1 and 23.3 degrees C.) in order to obtain the best results. If the media 22 is shot below this temperature excessive cracking may be experienced and if shot above this temperature range total catastrophic loss of integrity may occur depending on the impact velocity, expansion and diameter of the bullet 30 tested. Regardless, the preferred media 22 maintains consistency at a wide range of temperatures and results are quantifiable and predictable. To maintain its structural integrity and provide meaningful comparisons of a variety of bullets 30 from an assortment of cartridges, the core temperature of the media 22 for every shot should be within the above stated temperature window, or ideally the same temperature.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

ELEMENT DESIGNATION

For Convenience of the Examiner, Not Part of the Specification

10 bullet test tube
20 wound cavity
22 media
24 cylindrical tube
26 open ends (of 24)
28 foil liner (of 24)
30 bullet
32 basic test tube
33 target disk
34 extender
36 short magnum extender
38 magnum extender
40 ultra magnum extender
42 super tube
44 flat base (of 48 and 50)
46 circular side wall (of 48 and 50)
47 secondary inner liner (on 50)
48 basic cover
50 extender cover
52 bullet penetration
54 bullet entrance hole
56 marking guide lines
58 width (of 20)
60 depth (of 20)
62 length of penetration

The invention claimed is:

1. A bullet test tube for bullet recovery, measuring a wound cavity and penetration in a media imparting stresses similar to what a bullet passing thru animal tissues encounters which comprises, a) at least one cylindrical tube having open ends, b) said media disposed within the at least one cylindrical tube wherein said media is cast in a heated liquefied state and solidified at normal prevailing ambient temperatures, and c) means for covering each open end of the at least one cylindrical tube preventing debris contamination during handling also providing shipping enclosures.

2. A bullet test tube for bullet recovery, measuring a wound cavity and penetration in a media imparting stresses similar to what a bullet passing thru animal tissues encounters which comprises, a) at least one cylindrical tube having open ends, wherein said at least one cylindrical tube further comprises a cardboard tubular shipping container having a foil liner b) said media disposed within the at least one cylindrical tube wherein said media is cast in a heated liquefied state and solidified at normal prevailing ambient temperatures, and c) means for covering each open end of the at least one cylindrical tube preventing debris contamination during handling also providing shipping enclosures.

3. The bullet test tube as recited in claim 2 wherein said at least one cylindrical tube further having an inside diameter of essentially 5.75 inches (14.60 cm) with a 0.0625 inch (0.16 cm) thick wall forming a basic test tube.

4. The bullet test tube as recited in claim 3 wherein said basic test tube further comprises a length of essentially 11.00 inches (27.94 cm) long with the media contained within the full length of the basic test tube.

5. The bullet test tube as recited in claim 3 further comprising a target disk disposed within an open end of said basic test tube for aiming a bullet to enter into the center of the test tube for optimum evaluation.

6. The bullet test tube as recited in claim 2 wherein said at least one cylindrical tube further having an inside diameter of essentially 5.875 inches (14.60 cm) with a 0.0625 inch (0.16 cm) thick wall forming an extender.

7. The bullet test tube as recited in claim 6 wherein said extender further comprises a length of essentially 5.50 inches (13.97 cm) to 11.00 inches (27.94 cm) long with the media contained within from 4.00 to 10.00 inches (10.16 to 25.4 cm) from one open end.

8. The bullet test tube as recited in claim 2 wherein said at least one cylindrical tube further having an inside diameter of essentially 5.75 inches (14.60 cm) with a 0.0625 inch (0.16 cm) thick wall forming a super tube.

9. The bullet test tube as recited in claim 8 wherein said super tube further comprises a length of essentially 18.00 inches (45.72 cm) long with the media contained within the full length of the super tube.

10. A bullet test tube for bullet recovery, measuring a wound cavity and penetration in a media imparting stresses similar to what a bullet passing thru animal tissues encounters which comprises, a) at least one cylindrical tube having open ends, b) said media disposed within the at least one cylindrical tube wherein said media is cast in a heated liquefied state and solidified at normal prevailing ambient temperatures, wherein said media further comprises a mixture of microcrystalline and paraffin wax having a melt point of 165 to 175 degrees F. (73.89 to 79.44 degrees C.) and a viscosity of 14.3 to 18.0 at 210 degrees F. (98.89 degrees C.) and c) means for covering each open end of the at least one cylindrical tube preventing debris contamination during handling also providing shipping enclosures.

11. The bullet test tube as recited in claim 10 wherein said mixture of microcrystalline and paraffin wax further comprises from 90 to 95 percent microcrystalline wax.

12. The bullet test tube as recited in claim 10 wherein said means for covering each open end of the at least one cylindrical tube further comprises a cover with an essentially flat base having a circular side wall with an inside diameter sufficiently large to slip over the outside diameter of the cylindrical tube, sealing the media from the surrounding environment.

13. The bullet test tube as recited in claim 12 wherein said cover is configured to fit over a bullet test tube.

14. The bullet test tube as recited in claim 10 wherein said means for covering an open end of the at least one cylindrical tube further comprises a cover with an essentially flat base having a circular side wall the same diameter as the tube with a secondary inner liner having a diameter sized to slip into the tube thereby sealing the media from the surrounding environment.

15. The bullet test tube as recited in claim 14 wherein said cover is configured to fit onto an extender.

16. A method for measuring a bullet wound cavity and penetration along with recovering and analyzing an expanded bullet in a media which comprises the steps of:

a) heating the media defined as a mixture of microcrystalline and paraffin wax having a viscosity of 14.3 to 18.0 at 210 degrees F. (98.89 degrees C.) to a temperature of from 165 degrees F. to 175 degrees F. (73.89 to 79.44 degrees C.) until melted, b) pouring the melted media slowly into a cylindrical tube to prevent air pockets and bubbles, c) cooling the media within the cylindrical tube at a temperature of from 65 to 75 degrees F. (18.33 to 23.89 degrees C.) for a period of no less than 48 hours allowing the media to stabilize at the prevailing ambient room temperature, d) firing a bullet from a firearm at a distance of at least 20 yards (18.29 meters) into the center of one end of the media inside the cylindrical tube, e) pouring water into an entrance hole in the media created by the fired bullet, f) measuring the water and recording the volume of the wound cavity created by the path of the fired bullet, g) marking guide lines across a longitudinal axis of the cylindrical tube 180 degrees apart, h) cutting the media and cylindrical tube in half using the marking guide lines to assure equal halves, i) measuring the maximum expansion width, and depth of the wound cavity, j) measuring the length of the bullet penetration into the media, k) recovering the expanded bullet from the media, l) measuring the maximum diameter and the weight of the expanded bullet, m) comparing the weight of the expanded bullet with an identical unfired bullet and calculating the percentage of bullet weight loss, and n) computing the terminal sectional density of the expanded bullet.

17. A method for measuring a bullet wound cavity and penetration along with recovering and analyzing an expanded bullet in a pre-used media which comprises the steps of:

a) collecting the pre-used media from a previous test and discarding the cut cylindrical tube, b) cutting the media into useable portions, c) melting the media with indirect heat at a temperature above 175 degrees F. (79.44 degrees C.) until liquefied, d) obtaining an uncut cylindrical tube and pouring the melted media slowly into the tube precluding any air pockets and bubbles, e)) cooling the media within the cylindrical tube at a temperature of from 65 to 75 degrees F. (18.33 to 23.89 degrees C.) for a period of no less than 48 hours allowing the media to stabilize at the prevailing ambient room temperature, f) firing a bullet from a firearm from a distance of at least 20 yards (18.29 meters) into the center of one end of the media inside the cylindrical tube, g) pouring water into an entrance hole in the media created by the fired bullet, h) measuring the water and recording the volume of the wound cavity created by the path of the fired bullet, i) marking guide lines across a longitudinal axis of the cylindrical tube 180 degrees apart, j) cutting the media and cylindrical tube in half through the marking guide lines, k) measuring the maximum expansion width, and depth of the wound cavity to assure equal halves, l) measuring the length of the bullet penetration into the media, m) recovering the expanded bullet from the media, n) measuring the maximum diameter and the weight of the expanded bullet, o) comparing the weight of the expanded bullet with an identical unfired bullet and calculating the percentage of bullet weight loss, and p) computing the terminal sectional density of the expanded bullet.

* * * * *